US012523419B2

(12) United States Patent
Matsubayashi

(10) Patent No.: US 12,523,419 B2
(45) Date of Patent: Jan. 13, 2026

(54) TEMPERATURE ADJUSTMENT DEVICE AND TEMPERATURE ADJUSTMENT SYSTEM

(71) Applicant: GOTO CONCRETE CO., LTD., Aichi (JP)

(72) Inventor: Hideyoshi Matsubayashi, Aichi (JP)

(73) Assignee: GOTO CONCRETE CO., LTD., Aichi (JP)

( * ) Notice: Subject to any disclaimer, the term of this patent is extended or adjusted under 35 U.S.C. 154(b) by 186 days.

(21) Appl. No.: 18/017,912

(22) PCT Filed: Jun. 30, 2021

(86) PCT No.: PCT/JP2021/024689

§ 371 (c)(1),
(2) Date: Jan. 25, 2023

(87) PCT Pub. No.: WO2022/024644

PCT Pub. Date: Feb. 3, 2022

(65) Prior Publication Data

US 2023/0280092 A1 Sep. 7, 2023

(30) Foreign Application Priority Data

Jul. 27, 2020 (JP) ..... 2020-126246

(51) Int. Cl.
*F25D 31/00* (2006.01)
*F25D 17/02* (2006.01)

(52) U.S. Cl.
CPC ..... *F25D 31/002* (2013.01); *F25D 17/02* (2013.01); *F25D 31/006* (2013.01); *F25D 2700/121* (2013.01)

(58) Field of Classification Search
CPC .... F25D 31/006; F25D 31/002; F25D 31/003; F25D 17/02; F25D 1/00; F25D 1/02; F25D 2700/121
See application file for complete search history.

(56) References Cited

U.S. PATENT DOCUMENTS

2020/0191452 A1 6/2020 Abell

FOREIGN PATENT DOCUMENTS

| | | | |
|---|---|---|---|
| CN | 208395132 | | 1/2019 |
| EP | 1 785 553 | | 5/2007 |
| JP | H06169751 A | * | 6/1994 |
| JP | 8-252034 | | 10/1996 |

(Continued)

OTHER PUBLICATIONS

International Search Report issued Sep. 21, 2021 in International (PCT) Application No. PCT/JP2021/024689.

*Primary Examiner* — Tavia Sullens
(74) *Attorney, Agent, or Firm* — Wenderoth, Lind & Ponack, L.L.P.

(57) ABSTRACT

A temperature adjustment device is for adjusting a temperature of wine stored in a concrete wine tank. The temperature adjustment device includes a circulation pipe, a circulation liquid inside the circulation pipe, and a temperature adjuster for adjusting a temperature of the circulation liquid. The circulation pipe includes an inlet port configured to be on a surface of the concrete wine tank, an outlet port configured to be on the surface of the concrete wine tank, and a main pipe portion configured to be embedded in a wall of the concrete wine tank.

15 Claims, 11 Drawing Sheets

(56) References Cited

FOREIGN PATENT DOCUMENTS

| | | | | |
|---|---|---|---|---|
| JP | 2013-111046 | | | 6/2013 |
| JP | 2013111046 | A | * | 6/2013 |
| JP | 2019-154260 | | | 9/2019 |
| JP | 2019154260 | A | * | 9/2019 |
| WO | 2020/016519 | | | 1/2020 |

* cited by examiner

NATURAL CONVENTION INSIDE WINE TANK WHEN LOWER-SIDE TEMPERATURE IS HIGHER THAN UPPER-SIDE TEMPERATURE BY ABOUT 1 TO 2℃

TEMPERATURE ADJUSTMENT DEVICE AND TEMPERATURE ADJUSTMENT SYSTEM

TECHNICAL FIELD

The present invention relates to a temperature adjustment device and a temperature adjustment system, capable of fermenting, storing, and maturing (aging) stored wine at an appropriate temperature by adjusting the temperature of wine stored in a concrete wine tank.

BACKGROUND ART

A material of a container for fermenting grapes as a raw material of wine, or a material of a container for storing and maturing (aging) wine is a very important factor for producing wine because it has a great influence on the finish of wine.

Until the 1970s, many wineries built concrete tanks by applying concrete on site as part of a building as a container for fermenting grapes or a container for storing and maturing (aging) wine, and the concrete tanks were used to produce wine.

Thereafter, from the 1970s onwards, stainless-steel tanks, which are easy to control temperature, easy to sterilize, and easy to manage hygiene, were developed and became widespread worldwide.

However, in recent years, more and more vintners are switching from the stainless-steel tanks to the concrete tanks again.

The concrete tanks are less likely to transfer the scent of concrete itself to wine, allowing the wine to maintain its neutrality. Furthermore, like oak tanks, the concrete tanks are breathable, so that a small amount of oxygen can be supplied to wine to allow the wine to breathe. Furthermore, internal sterilization or cleaning is easier, compared to the oak tanks.

In addition, since the walls of the concrete tanks are sufficiently thick, they are less susceptible to external temperature change than stainless-steel tanks, and necessity for temperature control caused by the influence of the external environment is reduced, compared to the stainless-steel tanks.

Furthermore, in addition to these characteristics, in recent years, various shapes of concrete tanks such as stand-alone rectangular parallelepiped tanks, cone-shaped tanks, or egg-shaped tanks have been developed and manufactured, which were previously installed as part of a building.

Here, for wine making, the temperature of wine in a tank rises when grapes, as a raw material of the wine, are fermented. For wine making, the fermentation temperature has a great influence on the finish of wine, and is usually controlled at 30° C. or lower for red wine and around 20° C. for white wine.

In addition, since the temperature at which the wine is stored and matured (aged) after fermentation has an effect on the aroma, taste, or the like of the wine, it is known that, in general, the appropriate temperature for maturing (aging) wine is 10 to 15° C. Therefore, when the temperature of wine in a tank rises to 20° C. or over, it is more likely that the maturing (aging) progresses too much, or the wine becomes oxidized.

Therefore, for managing the temperature of wine in a tank, for example, in the case of cooling, a temperature control device such as an iron plate is placed in the tank, or a metal temperature control pipe is installed inside the tank.

However, in these methods, there is a problem that metal comes into direct contact with wine, which can affect the aroma or taste of the wine. As a result, h is difficult to produce wine by taking advantage of the characteristics of concrete wine tanks.

CITATION LIST

Patent Documents

[Patent Document 1] Japanese Unexamined Patent Application Publication No. 2019-154260

SUMMARY OF INVENTION

Problems to be Solved by the Invention

Thus, the present invention has been made to address the aforementioned problems of the prior art, and it is therefore an object of the present invention to provide a temperature adjustment device and a temperature adjustment system for a concrete wine tank, capable of maintaining a uniform temperature of wine by controlling the temperature in a wine tank without allowing a metal pipe to make direct contact with the wine when adjusting the temperature of the wine in the tank.

Solution to Problems

According to an aspect of the present invention, there is provided a temperature adjustment device for adjusting a temperature of wine stored in a concrete wine tank, comprising: a circulation pipe; a circulation liquid circulating inside the circulation pipe; and a temperature adjuster that adjusts a temperature of the circulation liquid, wherein the circulation pipe has an inlet port and an outlet port provided on a concrete surface, and a main pipe portion embedded in a concrete wall, the temperature adjuster has a circulation coupling portion coupled to the inlet port and the outlet port of the circulation pipe, and the circulation liquid circulates inside the main pipe portion while the temperature of the circulation liquid is adjusted.

The temperature adjustment device described above may further comprise a measurement sensor installed in the wine tank to measure the temperature of the wine, wherein a temperature of the temperature adjuster is set on a basis of the wine temperature measured by the measurement sensor.

In the temperature adjustment device described above, the temperature adjustment devices may be installed in two places in a vertical direction of the concrete wine tank, and setting temperatures of the temperature adjustment devices installed in the two places may be differently set.

According to another aspect of the present invention, there is provided a temperature adjustment device for adjusting a temperature of wine stored in a concrete wine tank, comprising: a circulation pipe; an underground water circulating inside the circulation pipe; and an extraction pump that pumps up the underground water, wherein the circulation pipe has an inlet port and an outlet port provided on a concrete surface, and a main pipe portion embedded in a concrete wall, a feeding pipe portion of the extraction pump that pumps up the underground water is coupled to the inlet port of the circulation pipe, the outlet port is coupled to a discharge pipe portion, and the underground water pumped up by the extraction pump circulates inside the main pipe portion.

According to further another aspect of the present invention, there is provided a temperature adjustment device for adjusting a temperature of wine stored in a concrete wine tank, comprising: a circulation pipe; an underground water circulating inside the circulation pipe; an extraction pump that pumps up the underground water; and a temperature adjuster that adjusts a temperature of the underground water pumped up by the extraction pump, wherein the temperature adjuster is coupled to a feeding pipe portion of the extraction pump to receive the underground water, the circulation pipe has an inlet port and an outlet port provided on a concrete surface, and a main pipe portion embedded in a concrete wall, the temperature adjuster has a circulation coupling portion coupled to the inlet port and the outlet port of the circulation pipe, and the received underground water circulates inside the main pipe portion while the temperature of the underground water is adjusted.

According to still another aspect of the present invention, there is provided a temperature adjustment system comprising a control device that adjusts and controls a temperature of wine stored in a concrete wine tank, the control device having a receiver that receives the wine temperature measured by a measurement sensor installed in the wine tank and a control unit that controls the received wine temperature, wherein the control unit has a temperature controller that acquires the wine temperature measured by the measurement sensor from the receiver and a temperature setting unit that sets an appropriate temperature of the wine in the tank in advance, the wine temperature acquired by the temperature controller is compared with the appropriate temperature of the temperature setting unit, the temperature controller instructs a temperature adjuster to increase or decrease the temperature on a basis of a result of the comparison, and the circulation liquid circulates while the temperature thereof is adjusted by the temperature adjuster on a basis of the instruction.

According to still further another aspect of the present invention, there is provided a temperature adjustment system comprising a control device that adjusts and controls a temperature of wine stored in a concrete wine tank, the control device having a receiver that receives the wine temperature measured by a measurement sensor installed in the wine tank and a control unit that controls the received wine temperature, wherein the control unit has a temperature controller that acquires the wine temperature measured by the measurement sensor from the receiver, a temperature setting unit that sets an appropriate temperature of the wine in the tank in advance, and a temperature change rapid controller that adjusts a flow rate and speed of a circulation liquid flowing through a circulation pipe to rapidly change a temperature of the circulation liquid, the wine temperature acquired by the temperature controller is compared with the appropriate temperature of the temperature setting unit, the temperature controller instructs a temperature adjuster to increase or decrease the temperature on a basis of a result of the comparison, and the circulation liquid circulates while the temperature thereof is adjusted by operation of the temperature adjuster and operation of the temperature change rapid controller on a basis of the instruction.

Advantageous Effects of the Invention

According to the present invention, it is possible to provide a temperature adjustment device and a temperature adjustment system for a concrete wine tank, capable of maintaining a uniform temperature of wine by controlling the temperature in a wine tank without allowing a metal pipe to make direct contact with the wine when adjusting the temperature of the wine in the tank.

DESCRIPTION OF EMBODIMENTS

First, a structure of the concrete wine tank 9 will be described in brief.

Figure 3:
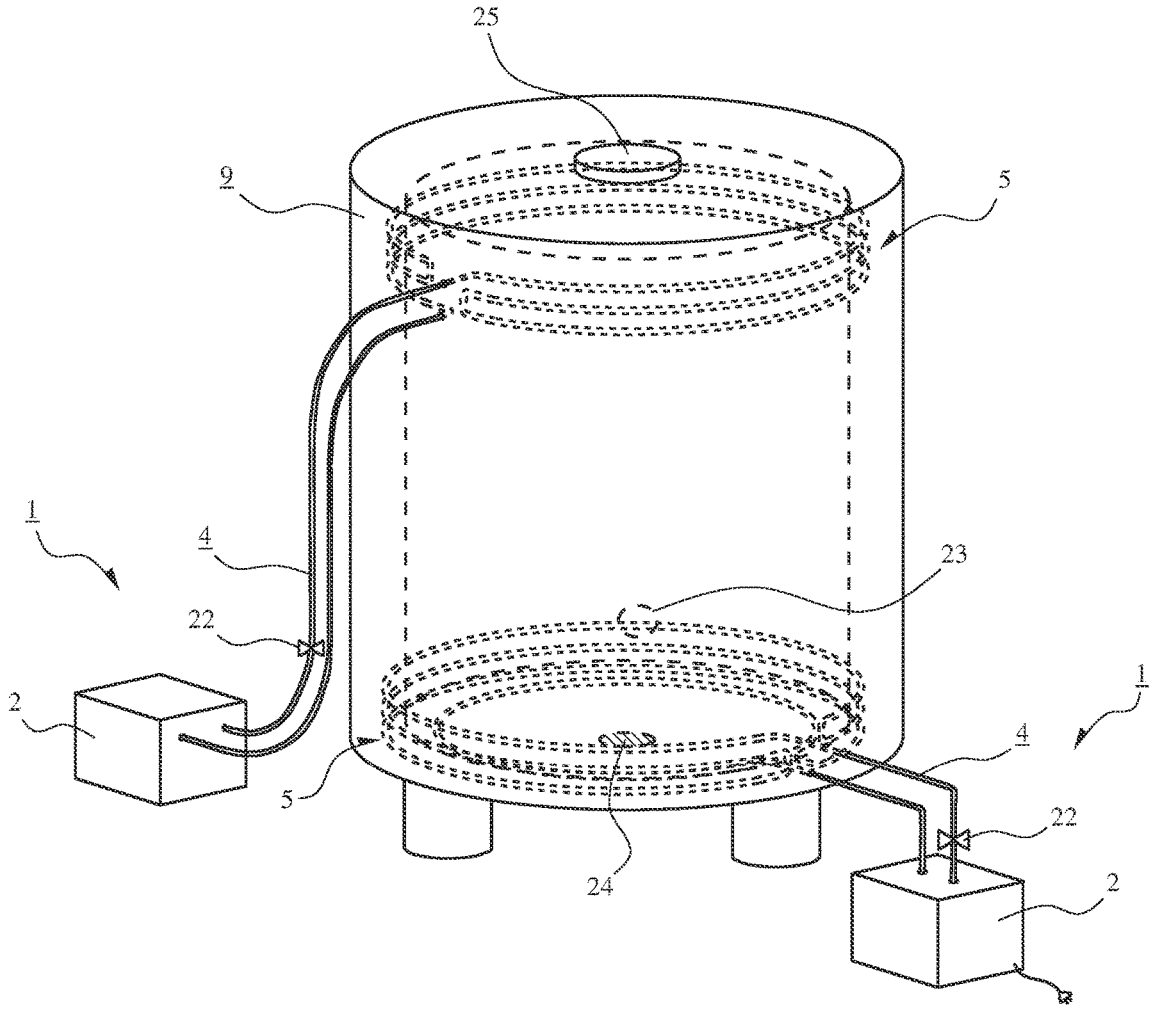
FIG. 3 is a configuration explanatory diagram (3) for illustrating a configuration according to the present invention.

A lid 25 is provided on the upper surface of the wine tank 9 as shown in FIG. 3, and the inside of the wine tank 9 can be checked from this portion.

Figure 1:
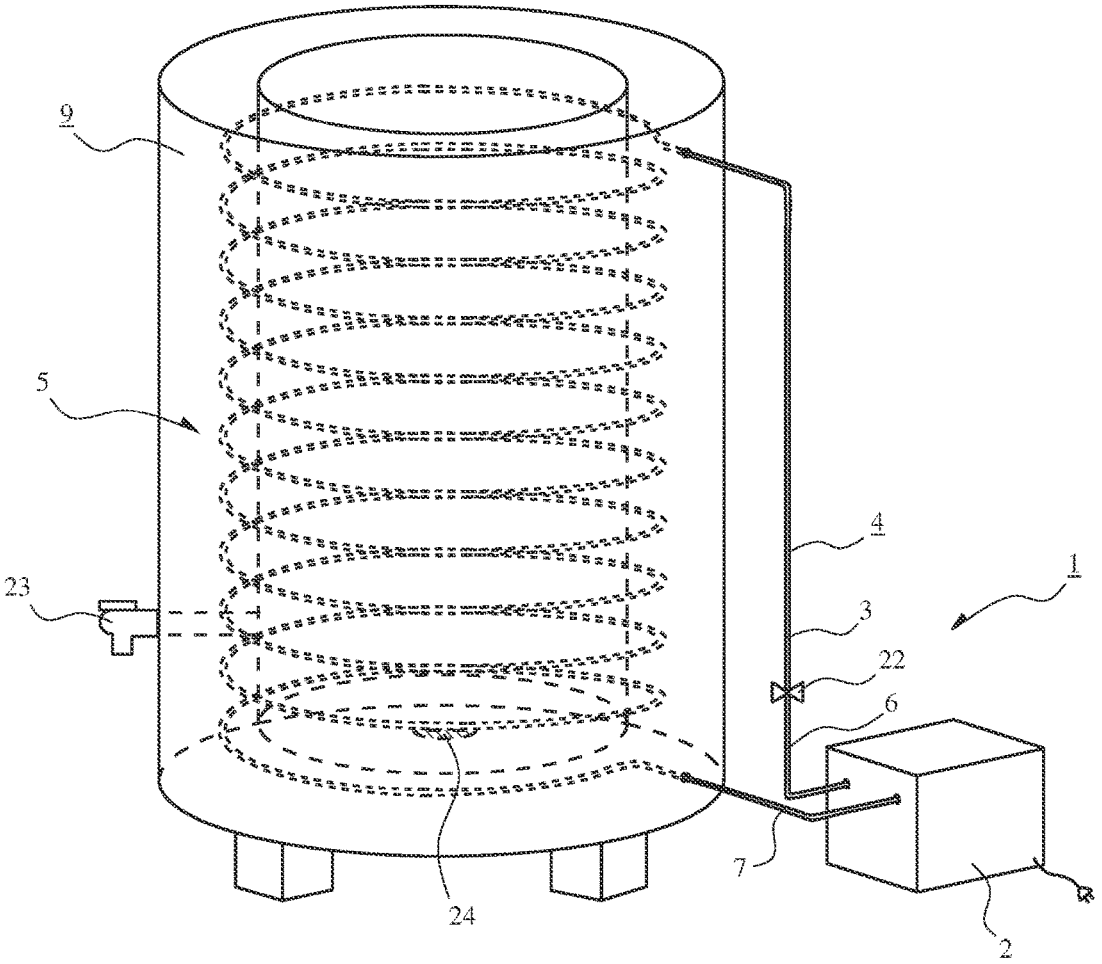
FIG. 1 is a configuration explanatory diagram (1) for illustrating a configuration according to the present invention.

In addition, as shown in FIG. 1, an upper valve 23 is provided on the outer lower wall surface of the wine tank 9. This upper valve 23 is used for extracting the wine (supernatant). Furthermore, a lower valve 24 is provided on the bottom surface of the wine tank 9. The lower valve 24 is for draining the sediment accumulated at the bottom of the wine tank 9.

The present invention will now be described with reference to the accompanying drawings.

FIG. 1 is a configuration explanatory diagram for explaining a configuration according to the first embodiment of the present invention.

In FIG. 1, reference numeral "1" refers to a temperature adjustment device. The temperature adjustment device 1 is a device for adjusting the temperature of wine 10 stored in the concrete wine tank 9. In addition, the temperature adjustment device 1 includes a circulation pipe 4 having a portion embedded in the wall of the wine tank 9 so as to allow circulation inside the concrete wine tank 9 in a ring shape, a circulation liquid 3 circulating inside the circulation pipe 4, and a temperature adjuster 2 for adjusting the temperature of the circulation liquid 3.

As the circulation liquid 3 whose temperature is adjusted by the temperature adjuster 2 circulates in the circulation pipe 4, heat exchange is achieved, so that the temperature of the wine 10 in the wine tank 9 can be cooled or heated. As the circulation liquid 3, for example, liquid such as water or underground water whose temperature is kept constant at all seasons may be conceivable.

In addition, the circulation pipe 4 has an inlet port 6 and an outlet port 7 provided on the concrete surface, and a main pipe portion 5 of the circulation pipe 4 is embedded in the concrete.

Here, the material of the circulation pipe is not limited, and a metal member that is easy to process and has excellent thermal conductivity may be conceivable. For example, a metal member such as stainless steel or copper may be employed. This metal member is fabricated to form the circulation pipe 4 having a circular cross-section or a semi-circular dome-shaped cross section.

In addition, the main pipe portion. 5 is installed and embedded into the concrete wall to match the shape of the wine tank 9. For example, as for the cylindrical wine tank 9 shown in FIG. 1, the main pipe portion 5 is installed in the concrete while is wound around the tank wall in a ring shape along the vertical direction of the tank. By embedding the main pipe portion 5 evenly along the vertical direction of the tank in this manner, the temperature of the wine in the tank can be uniformly controlled.

By embedding the main pipe portion 5 in the concrete as described above, the temperature of the wine 10 can be adjusted without allowing the metal member to make direct contact with the wine 10 in the tank 9. Therefore, the aroma or taste of wine is not affected by the metal member during fermentation, storage, or maturing (aging), so that the original aroma or taste of grapes can be enjoyed.

The temperature adjuster 2 and the circulation pipe 4 are connected to each other by coupling the circulation coupling portion of the temperature adjuster 2 to the inlet port 6 and the outlet port 7 of the circulation pipe 4. As a result, the circulation liquid 3 whose temperature is adjusted by the temperature adjuster 2 can be input from the inlet port 6 of the circulation pipe 4, pass through the main pipe portion 5, and be discharged from the outlet port 7 of the circulation pipe 4.

Note that a flow rate adjustment valve 22 for adjusting the flow rate of the circulation liquid 3 is provided on the inlet port 6 side of the circulation pipe 4. By changing the opening area of the flow rate adjustment valve 22, the flow rate or speed of circulation of the circulation liquid 3 through the main pipe portion 5 can be adjusted. Accordingly, it is possible to change the flow rate and circulation speed of the circulation liquid 3.

By widening the opening area of the flow rate adjustment valve 22, the flow rate of the circulation liquid 3 circulating through the main pipe portion 5 increases, and the circulation speed of the circulation liquid 3 also increases. As a result, heat exchange by the circulation liquid 3 becomes rapid, so that it is possible to rapidly cool or heat the temperature of the wine 10 in the tank 9.

Next, a second embodiment of the present invention will now be described.

Figure 2:
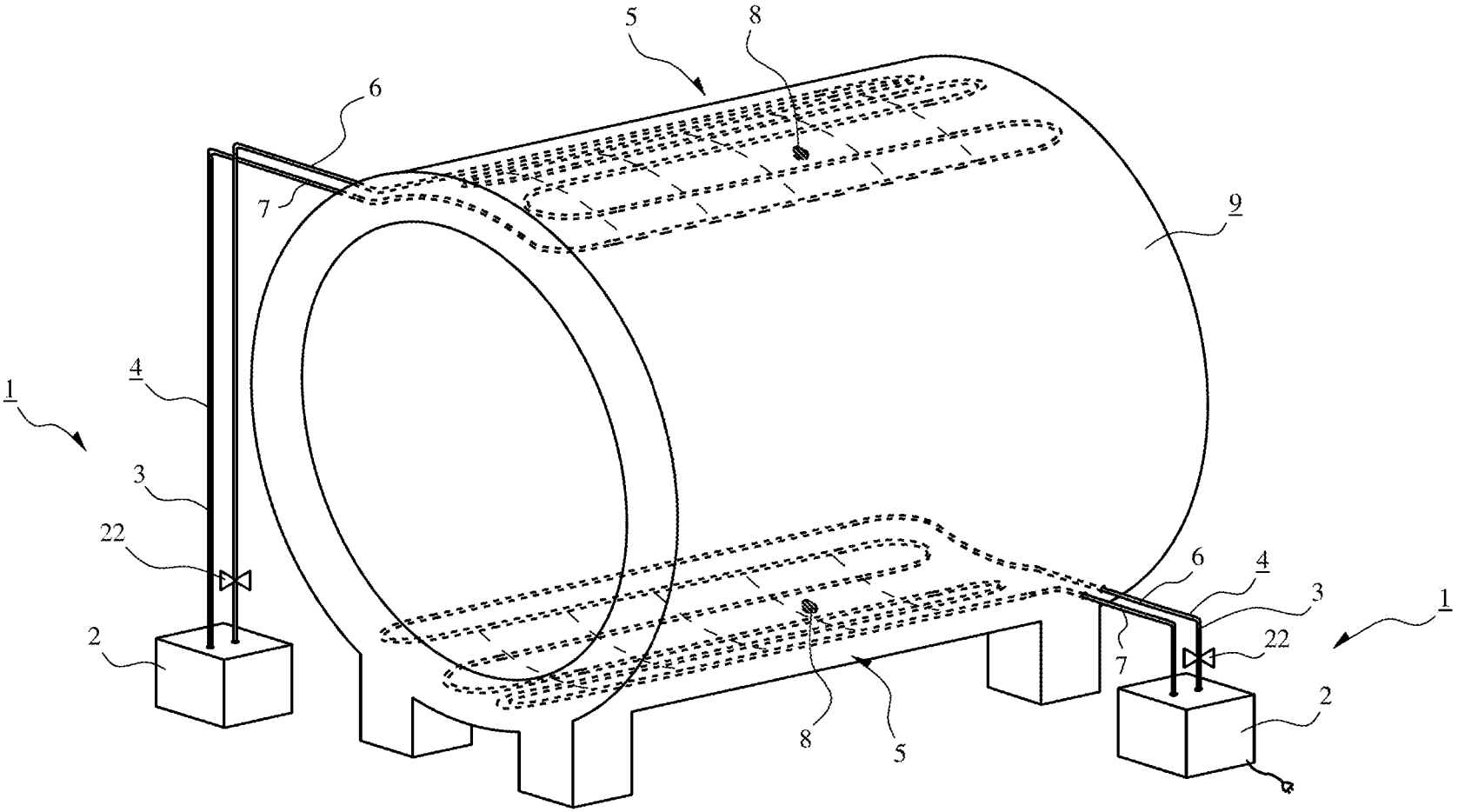
FIG. 2 is a configuration explanatory diagram (2) for illustrating a configuration according to the present invention.

The present invention may also be applied to a wine tank 9 having a laid-down cylinder shape as shown in FIG. 2. That is, in the wine tank 9 having a laid-down cylinder shape as shown in FIG. 2, for example, the main pipe portion 5 is embedded in the concrete wall while being bent in a zigzag shape along the horizontal longitudinal direction.

The embodiment of FIG. 2 is characterized in that the temperature adjustment devices 1 are provided in two places, one in the lower concrete wall and the other in the upper concrete wall.

In addition, gentle convection is generated in the wine of the wine tank by differently setting the temperature adjusted by the lower-side temperature adjustment device 1 and the temperature adjusted by the upper-side temperature adjustment device 1. By generating this gentle convection, it is possible to keep the quality of wine constantly high and uniform without degradation.

Figure 4:
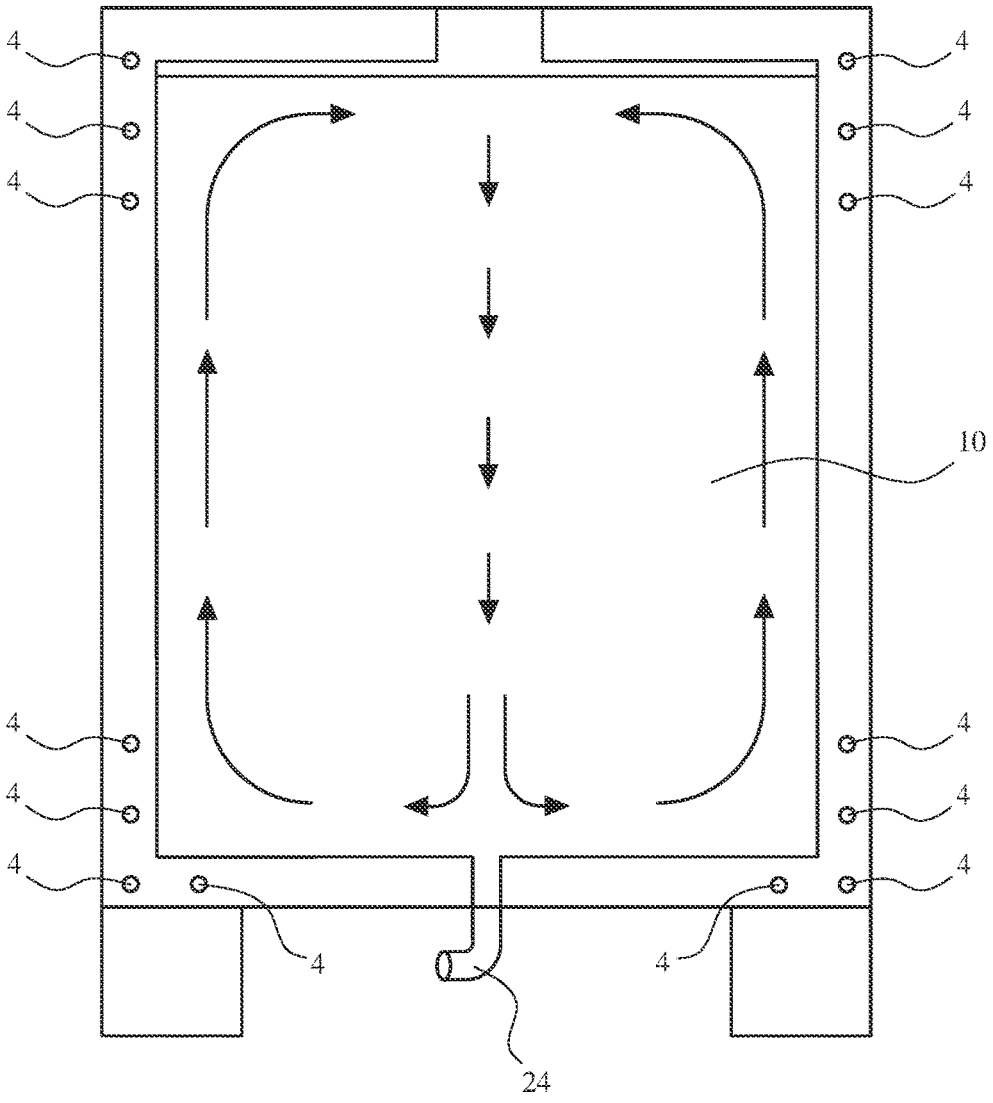
FIG. 4 is an explanatory diagram for explaining natural convection according to the present invention.
Figure 5:
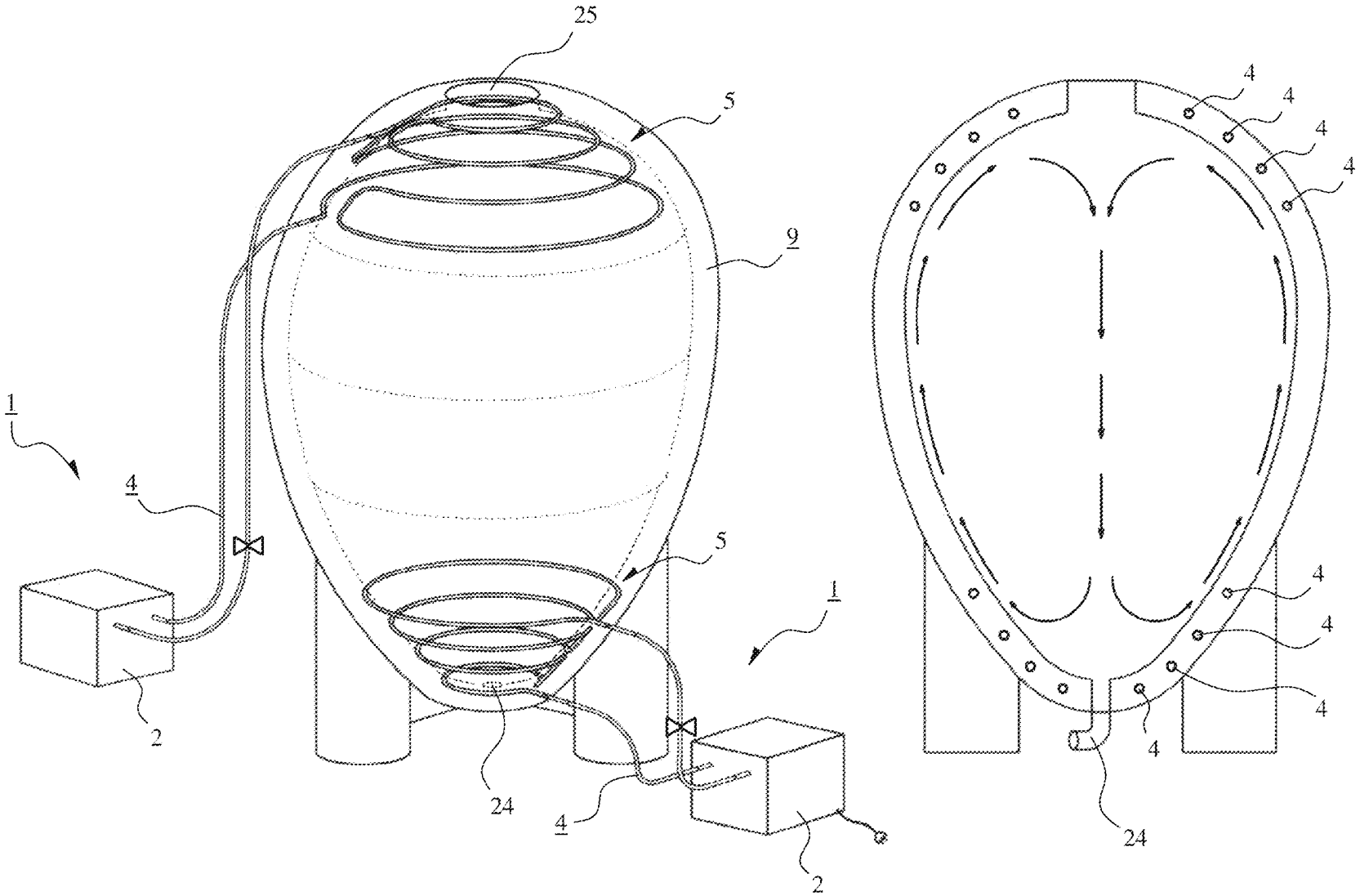
FIG. 5 is a configuration explanatory diagram (4) for illustrating a configuration according to the present invention.
Figure 6:
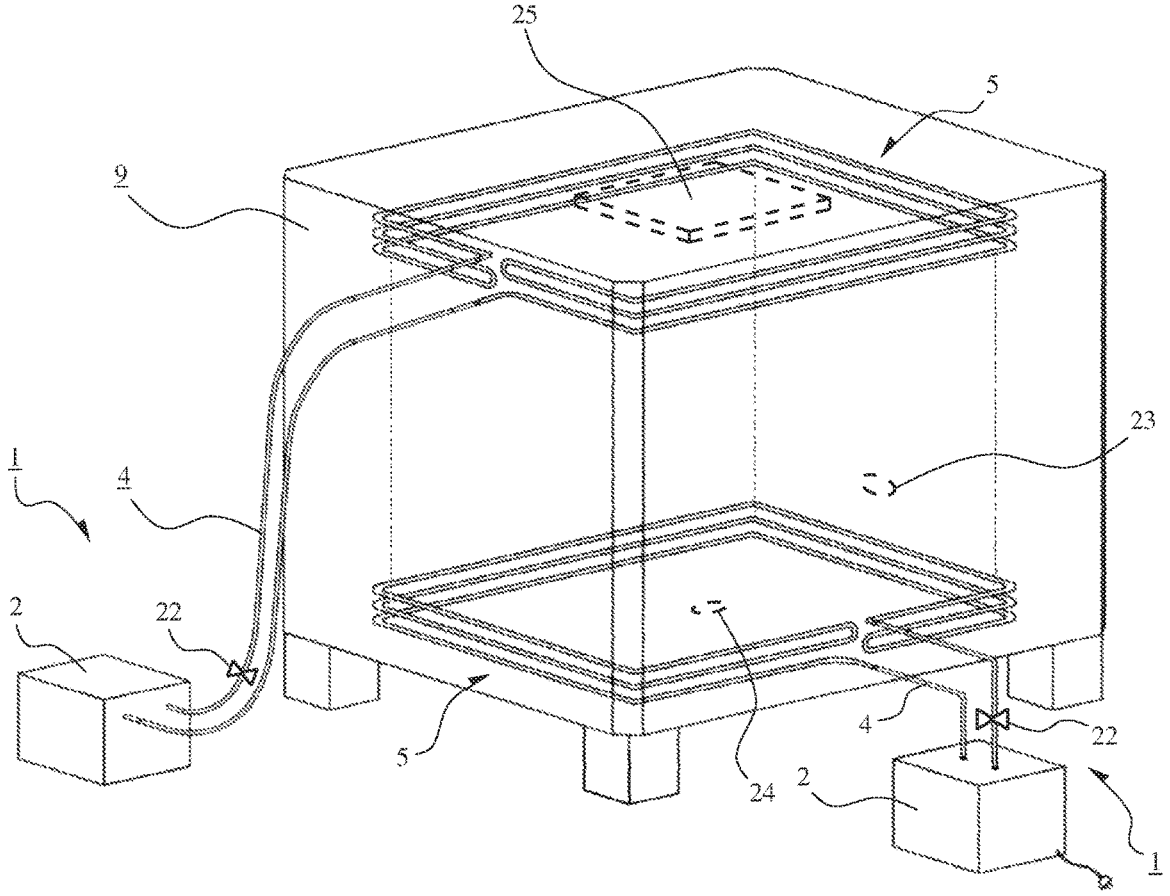
FIG. 6 is a configuration explanatory diagram (5) for illustrating a configuration according to the present invention.
Figure 7:
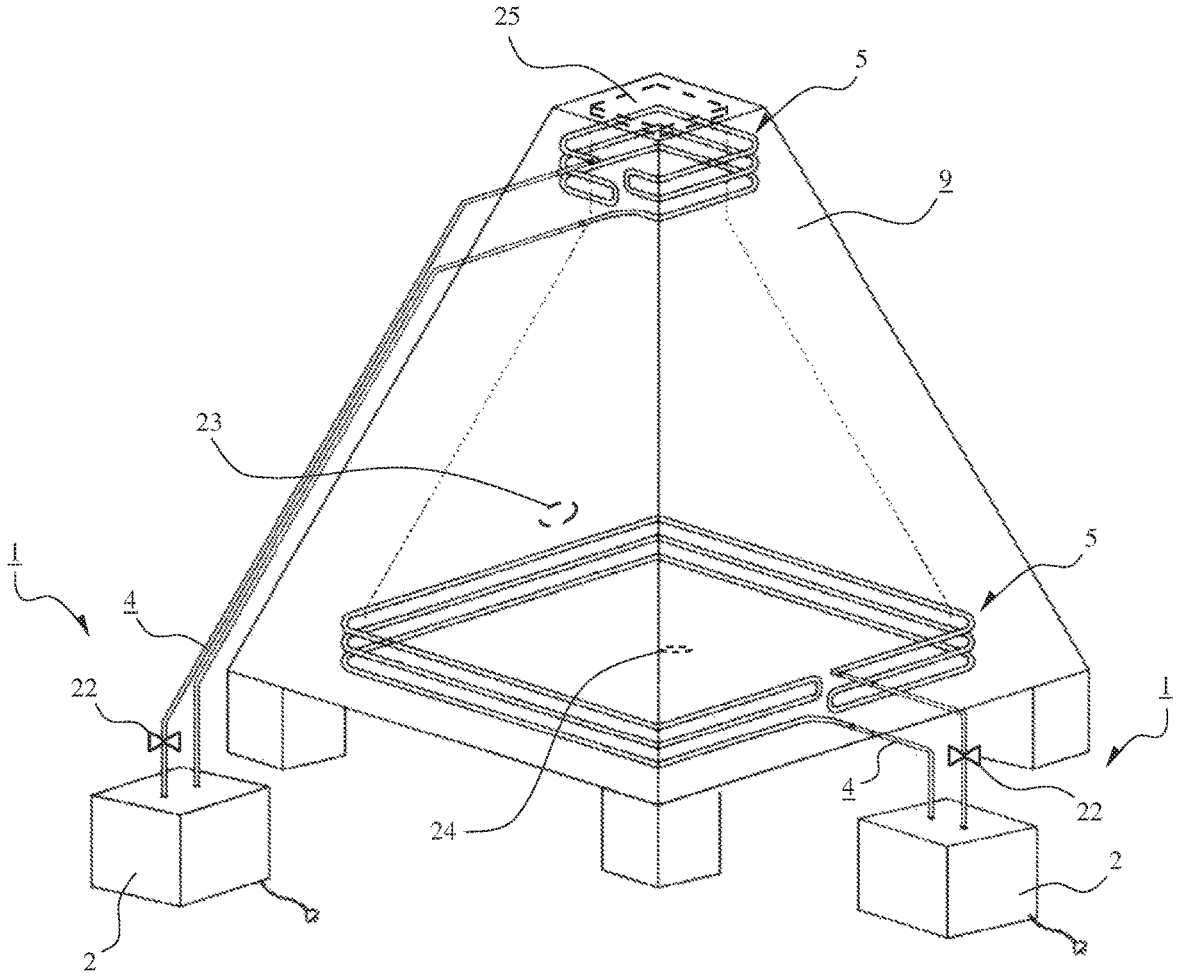
FIG. 7 is a configuration explanatory diagram (6) for illustrating a configuration according to the present invention.

Note that FIG. 3 shows a second specific example of the second embodiment, in which temperature adjustment devices 1 are installed in two places in the vertical direction of a cylindrical wine tank. FIG. 4 shows a convection state of the wine indicated by arrows according to the embodiment of FIG. 3. FIG. 5 shows an example in which the temperature adjustment devices 1 are installed in two places in the vertical direction of a substantially egg-shaped wine tank. Depending on the type of wine, aging in this egg-shaped wine tank produces better quality wine. Furthermore, the present invention may also be applied to a rectangular wine tank as shown in FIG. 6 or a triangular pyramidal wine tank as shown in FIG. 7. By selecting wine depending on each shape, it is possible to produce high quality wine.

Here, reference numeral "8" in FIG. 2 refers to a measurement sensor, and the measurement sensor 8 is provided for measuring the temperature of wine 10 in the wine tank 9. The place where the measurement sensor 8 is installed is not particularly limited, and for example, it may be installed on the wall inside the wine tank 9 or on the top or bottom surface as well. Alternatively, instead of installing the measurement sensor 8 in the wine tank 9, the measurement may be performed, for example, by inserting the measurement sensor 8 from a predetermined position as necessary.

Next, a third embodiment of the present invention will now be described.

Figure 10:
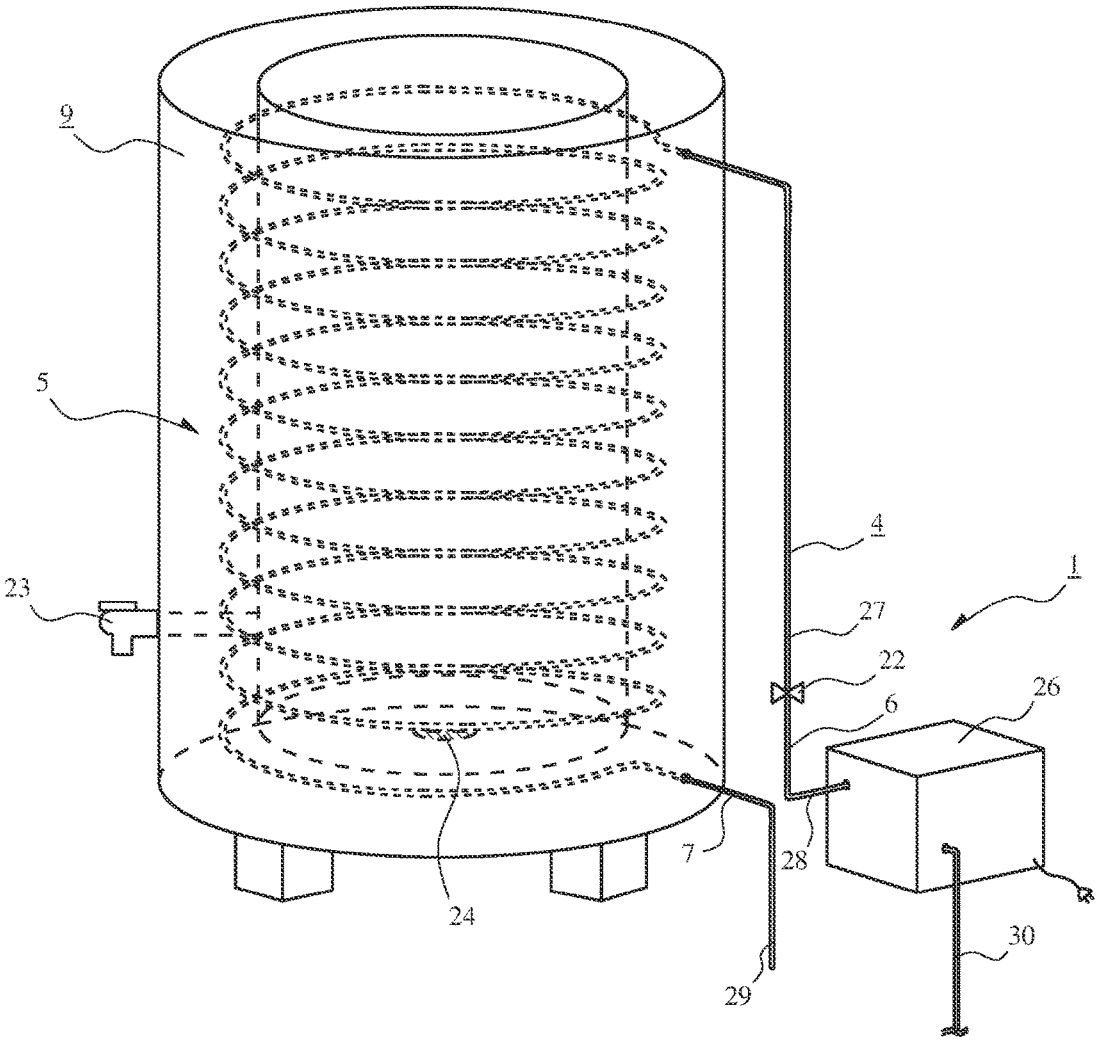
FIG. 10 is a configuration explanatory diagram (7) for illustrating configuration according to the present invention.

FIG. 10 is a configuration explanatory diagram for explaining a configuration according to the third embodiment of the present invention.

In the third embodiment, an underground water 27 pumped up by an extraction pump 26 is circulated in the circulation pipe 4 to lower the temperature of wine 10 in wine tank 9. Note that the structure of the extraction pump 26 is not particularly limited, and for example, an electric pump, a hydraulic pump, a piston pump, or the like may be conceivable.

Here, although the temperature of the underground water 27 varies depending on the region, it is generally known that it is almost constant throughout the year, and the annual temperature difference is within 1° C. For example, the underground water temperature in Hokkaido of Japan is about 8 to 16° C. throughout the year.

For this reason, by using the underground water 27, the temperature of the wine 10 can be maintained at 10 to 15° C., which is an appropriate temperature for storing and maturing (aging) wine in the tank. In addition, since the underground water having a temperature of about 8 to 1.6° C. is used, there is no need to adjust the temperature of the circulation liquid 3, which is very economical.

In addition, the extraction pump 26 has an underground water pumping pipe 30 for pumping up the underground water 27 and a feeding pipe portion 28 for feeding the pumped underground water 27 to the circulation pipe 4.

The extraction pump 26 and the circulation pipe 4 are connected to each other by coupling the feeding pipe portion 28 of the extraction pump 26 to the inlet port 6 of the circulation pipe 4. The outlet port 7 of the circulation pipe 4 is coupled to the discharge pipe portion 29 to discharge the underground water 27 from the circulation pipe 4.

As a result, the underground water 27 pumped up by the extraction pump 26 can flow from the inlet port 6 of the circulation pipe 4 coupled to the feeding pipe portion 28, pass through the main pipe portion. 5, and be discharged from the discharge pipe portion 29 coupled to the outlet port 7 of the circulation pipe 4.

Figure 11:
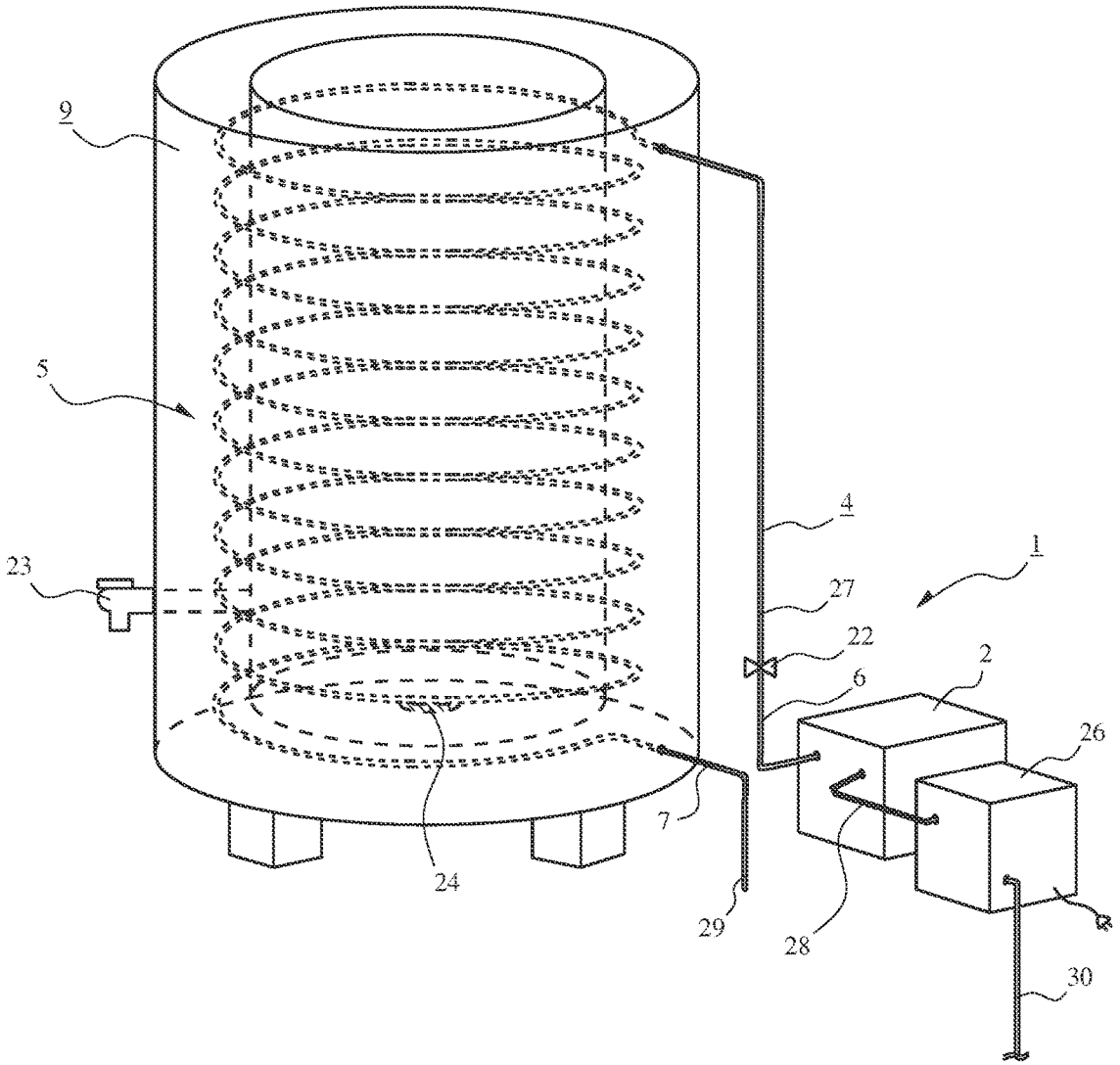
FIG. 11 is a configuration explanatory diagram (8) for illustrating a configuration according to the present invention.

Note that, when the temperature of the underground water 27 is higher or lower than the appropriate temperature, the temperature of the underground water 27 pumped up by the extraction pump 26 can be adjusted to the appropriate temperature by using the temperature adjuster 2 of the first or second embodiment in combination with the extraction pump 26 (see FIG. 11).

In this case, the underground water 27 can be introduced into the temperature adjuster 2 by coupling the feeding pipe portion 28 of the extraction pump 26 to the temperature adjuster 2.

In the following description, the temperature adjustment and temperature control in the temperature adjustment device 1 will be described.

According to the present invention, the temperature adjustment device 1 has a control device 11 provided to perform temperature adjustment and temperature control.

Figure 8:
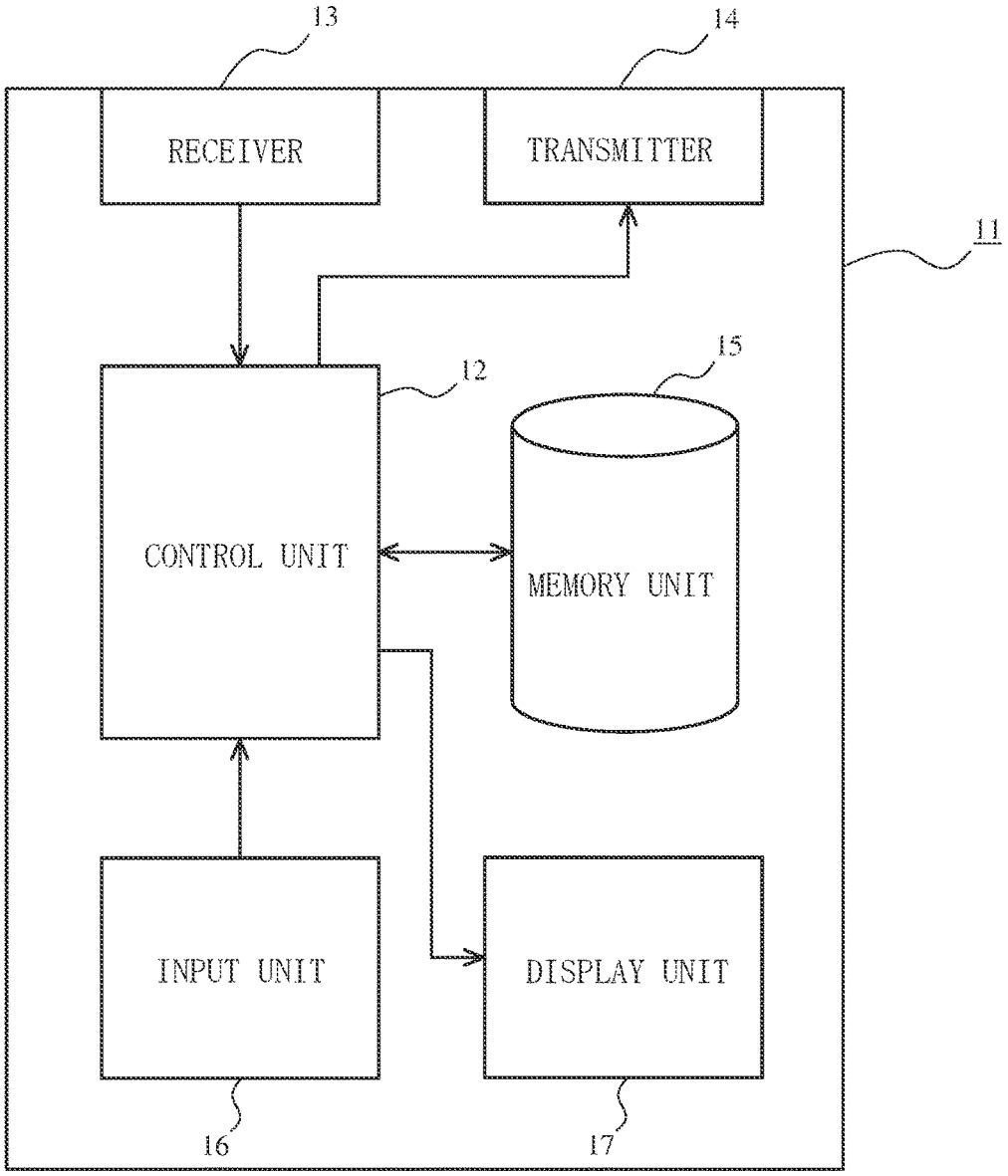
FIG. 8 is a configuration explanatory diagram for illustrating a configuration of a control device of the present invention.

As shown in FIG. 8, the control device 11 is provided in general as a separate device from the temperature adjustment device 1, and has a measurement sensor 8, a receiver 13 for receiving signals in a wireless or wired manner, and a transmitter 14 for transmitting various signals.

Note that, although the control device 11 is installed as a separate device from the temperature adjustment device 1 in this embodiment, the control device 11 and the temperature adjustment device 1 may be integrated as well.

Figure 9:
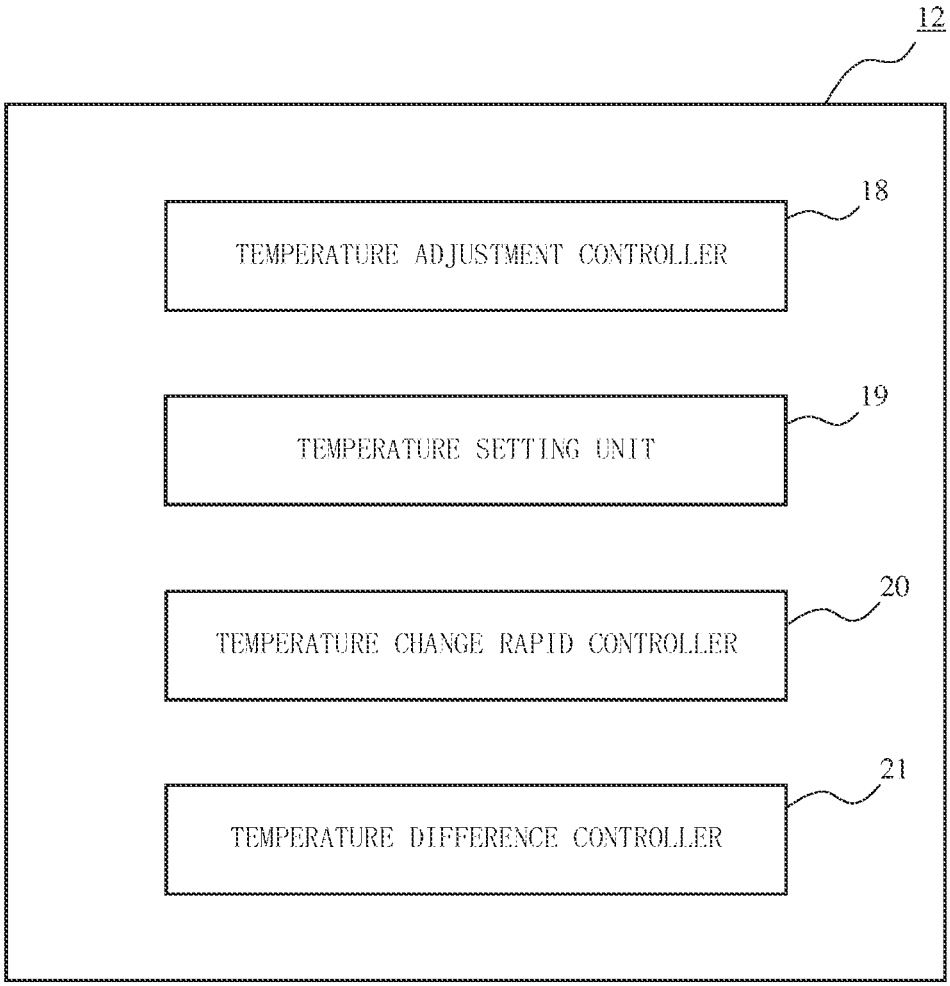
FIG. 9 is a configuration explanatory diagram for illustrating a configuration of a control unit of the present invention.

In addition, the control device 11 has a control unit 12 for performing various controls, a memory unit 15, an input unit 16, and a display unit 17. The control unit 12 shown in FIG. 9 has a temperature adjustment controller 18, a temperature setting unit 19, a temperature change rapid controller, and a temperature difference controller 21.

The temperature data of the wine 10 measured h the measurement sensor 8 is transmitted to the temperature adjustment controller 18 of the control unit 12 of the control device 11 in a wireless or wired manner, and the temperature adjustment controller 18 of the control unit 12 of the control device 11 acquires the temperature data of the wine 10 measured by the measurement sensor 8.

In addition, the temperature data of the wine 10 acquired by the temperature adjustment controller 18 is compared with the appropriate temperature of the temperature setting unit 19 of the control unit 12 in which the appropriate temperature of the wine in the tank is set in advance. When the acquired temperature data of the wine is higher than the appropriate temperature of the temperature setting unit 19, the temperature adjustment controller 18 operates the temperature adjuster 2 such that a cold circulation liquid 3 is introduced into the circulation pipe 4 to cool the wine 10 in the tank 9.

In addition, when the temperature data of the wine 10 measured by the measurement sensor 8 is lower than the appropriate temperature of the temperature setting unit 19, the temperature adjustment controller 18 operates the temperature adjuster 2 as described above so as to introduce the warm circulation liquid 3 into the circulation pipe 4 to heat the temperature of the wine 10 in the tank 9.

As a result, the temperature of the wine 10 in the tank 9 is constantly adjusted and is maintained at the optimum temperature for fermenting grapes or storing and maturing (aging) wine.

Furthermore, when the temperature data of the wine 10 measured by the measurement sensor 8 differs from the appropriate temperature of the temperature setting unit 19 by 5° C. or more, the temperature adjustment controller 18 of the control unit 12 of the control device 11 operates the temperature adjuster 2 and also transmits data to the temperature change rapid controller 20 of the control unit 12 of the control device 11.

Upon receipt of the data, the temperature change rapid controller 20 rapidly expands the opening area of the flow rate adjustment valve 22 provided on the inlet port 6 side of the circulation pipe 4, By widening the opening area of the flow rate adjustment valve 22, it is possible to increase the flow rate of the circulation liquid 3 circulating in the circulation pipe 4 and the circulation speed of the circulation liquid 3. As a result, it is possible to rapidly perform heat exchange by the circulation liquid 3, and rapidly adjust the temperature of the wine 10 in the tank 9 to the appropriate temperature.

Here, the appropriate temperature for fermenting grapes is generally controlled at a temperature of 30° C. or lower for red wine and around 20° C. for white wine. For this reason, the appropriate temperature of the temperature setting unit 19 is set such that the appropriate temperature for fermentation is set to an upper limit of 30° C. for red wine and an upper limit of 20° C. for white wine. As a result, it is possible to maintain the temperature of the wine 10 in the tank 9 at the optimum temperature.

In addition, it is known that the optimum temperature for storing and maturing (aging) wine is 10 to 15° C. Therefore, the temperature of the wine 10 in the tank 9 can be maintained within the best temperature range by setting the appropriate temperature of the temperature setting unit 19 to a lower limit of 10° C. and an upper limit of 15° C.

In this manner, the temperature setting unit 19 is configured to set the appropriate, temperature range depending on the state of the wine in the tank.

Next, reference numeral "21" refers to a temperature difference controller. When the temperature adjustment devices 1 are provided in two places in the vertical direction of the concrete wine tank 9, the temperature difference controller 21 is a controller for differently setting the temperatures of the temperature adjustment devices 1 provided in the two places (see FIGS. 2 and 3).

Specifically, from the measurement sensors 8 provided in the upper and lower sides of the tank 9, the measured upper-side temperature data and the measured lower-side temperature data of the wine 10 are transmitted to the temperature adjustment controller 18 of the control unit 12 of the control device 11 in a wireless or wired manner. In addition, the temperature adjustment controller 18 of the control unit 12 of the control device 11 acquires the upper-side temperature data and the lower-side temperature data of the wine 10 measured by each of the measurement sensors 8.

In addition, the upper-side and lower-side temperature data of the wine 10 acquired by the temperature adjustment controller 18 as described above are compared with the appropriate temperature set by the temperature setting unit 19 in which the appropriate temperature of the wine in the tank is set in advance.

In addition, when the acquired upper-side and lower-side temperature data of the wine 10 are within the appropriate temperature range of the temperature setting unit 19 as a result of the comparison, the upper-side and lower-side temperature data of the wine 10 acquired by the temperature adjustment controller 18 are transmitted to the temperature difference controller 21 of the control unit 12 of the control device 11.

In the temperature difference controller 21, upon receipt of the upper-side and lower-side temperature data, a setting temperature in which the upper-side and lower-side wine temperatures are set differently by about 1 to 2° C. is transmitted from the temperature difference controller 21 to the temperature adjustment controller 18 in order to make the upper-side and lower-side wine temperatures in the tank 9 different by about 1 to 2° C.

Here, for example, it is assumed that the temperature is set such that the lower-side wine temperature in the tank 9 is lower than the upper-side wine temperature by about 1° C.

In addition, the temperature adjustment controller 18 operates each temperature adjuster 2 of the temperature adjustment devices 1 provided in the two places in the vertical direction of the tank 9, so that the upper-side and lower-side wine temperatures are controlled to be different by about 1 to 2° C.

In addition, when the acquired upper-side and lower-side temperature data of the wine are not within the appropriate temperature range of the temperature setting unit 19 as a result of the comparison, the temperature adjustment controller 18 operates each temperature adjuster 2 at once, so that the temperature of the wine 10 in the tank 9 is controlled to be within the appropriate temperature range of the temperature setting unit 19.

In addition, after the temperature of the wine 10 in the tank 9 falls within the appropriate temperature range of the temperature setting unit 19, the upper-side and lower-side wine temperatures of the tank 9 are controlled to be different by about 1 to 2° C. through the process described above.

By controlling the upper-side and lower-side wine temperatures of the tank 9 to be different by about 1 to 2° C., it is possible to generate gentle natural convection in the wine 10 of the tank 9 and maintain the temperature of the wine 10 in the tank 9 constantly uniform as a whole.

Next, a method of fabricating the concrete wine tank will be described.

First, a mold having a predetermined shape is formed, and the main pipe portion 5 of the circulation pipe 4 is arranged in the mold. Then, concrete is poured into the mold in which the main pipe portion 5 is arranged, and is molded, in this case, the inlet port 6 and the outlet port 7 of the circulation pipe 4 are formed on the concrete surface.

In addition, the measurement sensor 8 may be installed in the molded concrete wine tank as necessary to measure the wine temperature at the upper, bottom, or wall surface inside the wine tank.

Note that, regarding the shape of the concrete wine tank, the size (capacity) of the wine tank may be determined in consideration of the place where the wine is produced, the amount of wine produced at one time, and the like. In addition, the shape of the concrete wine tank may be selected depending on the type of wine to be produced (red wine, white wine, or the like). For example, it is possible to fabricate the concrete wine tank shapes as shown in FIGS. 5 to 7. Note that, although the main pipe portions 5 in FIGS. 5 to 7 are indicated by the solid lines, they are embedded in the concrete in practice.

As described above, according to the present invention, since the main pipe portion 5 of the circulation pipe 4 is embedded in concrete, it is possible to adjust the wine temperature without allowing a metal member to make direct contact with the wine in the tank.

In addition, it is possible to manage the temperature of the wine in the tank in real time by using the measurement sensor 8. Furthermore, since a temperature difference of about 1 to 2° C. is generated between the upper-side and lower-side temperatures of the wine in the tank, it is possible to generate natural convection and maintain a uniform temperature throughout the wine,

REFERENCE SIGNS LIST

1 temperature adjustment device
2 temperature adjuster
3 circulation liquid
4 circulation pipe
5 main pipe portion
6 inlet port
7 outlet port
8 measurement sensor
9 concrete wine tank
10 wine
11 control device
12 control unit
13 receiver
14 transmitter
15 memory unit
16 input unit
17 display unit
18 temperature adjustment controller
19 temperature setting unit
20 temperature change rapid controller
21 temperature difference controller
22 flow rate adjustment valve
23 upper valve
24 lower valve
25 lid
26 extraction pump
27 underground water
28 feeding pipe portion
29 discharge pipe portion
30 underground water pumping pipe.

The invention claimed is:

1. A temperature adjustment system for wine stored in a concrete wine tank, the temperature adjustment system comprising:

a first temperature adjustment device; and a second temperature adjustment device, wherein each of the first temperature adjustment device and the second temperature adjustment device includes:

a circulation pipe including an inlet port configured to be on a surface of the concrete wine tank, an outlet port configured to be on the surface of the concrete wine tank, and a main pipe portion configured to be embedded in a wall of the concrete wine tank;

a circulation liquid inside the circulation pipe; and a temperature adjuster configured to adjust a temperature of the circulation liquid and coupled to the inlet port of the circulation pipe and the outlet port of the circulation pipe, wherein:

the first temperature adjustment device and the second temperature adjustment device are configured to circulate the circulation liquid inside the main pipe portion while the temperature of the circulation liquid is adjusted;

the first temperature adjustment device is configured to be at a first position in a vertical direction of the concrete wine tank;

the second temperature adjustment device is configured to be at a second position in the vertical direction of the concrete wine tank;

the first temperature adjustment device and the second temperature adjustment device are configured to control an upper-side temperature of the wine in the concrete wine tank and a lower-side temperature of the wine in the concrete wine tank to be different by 1° C. to 2° C.; and the circulation pipe of the first temperature adjustment device is discontinuous from the circulation pipe of the second temperature adjustment device such that the circulation pipe of the first temperature adjustment device is always in fluid noncommunication with the circulation pipe of the second temperature adjustment device.

2. The temperature adjustment system according to claim 1, further comprising:

a measurement sensor configured to be in the concrete wine tank and measure the upper-side temperature of the wine or the lower-side temperature of the wine, wherein the temperature adjuster is configured to set a temperature thereof based on the upper-side temperature of the wine or the lower-side temperature of the wine measured by the measurement sensor.

3. The temperature adjustment system according to claim 1, further comprising:

a control device, wherein:

the control device includes a receiver configured to receive the upper-side temperature of the wine or the lower-side temperature of the wine measured by a measurement sensor in the concrete wine tank, and a control unit configured to control the upper-side temperature of the wine or the lower-side temperature of the wine;

the control unit is configured to: (i) acquire, from the receiver, the upper-side temperature of the wine or the lower-side temperature of the wine measured by the measurement sensor; (ii) set a target temperature of the wine in the concrete wine tank; (iii) compare the upper-side temperature of the wine or the lower-side temperature of the wine acquired from the receiver with the target temperature; and (iv) instruct the temperature adjuster to increase or decrease the upper-side temperature of the wine or the lower-side temperature of the wine based on a result of the comparison; and the temperature adjustment system is configured to circulate the circulation liquid while the temperature of the circulation liquid is adjusted by the temperature adjuster based on the instruction to the temperature adjuster.

4. The temperature adjustment system according to claim 1, further comprising:

a control device, wherein:

the control device includes a receiver configured to receive the upper-side temperature of the wine or the lower-side temperature of the wine measured by a measurement sensor in the concrete wine tank, and a control unit configured to control the upper-side temperature of the wine or the lower-side temperature of the wine;

the control unit is configured to: (i) acquire, from the receiver, the upper-side temperature of the wine or the lower-side temperature of the wine measured by the measurement sensor; (ii) set a target temperature of the wine in the concrete wine tank; (iii) adjust a flow rate and a speed of the circulation liquid in the circulation pipe to change the temperature of the circulation liquid; (iv) compare the upper-side temperature of the wine or the lower-side temperature of the wine acquired from the receiver with the target temperature; and (v) instruct the temperature adjuster to increase or decrease the upper-side temperature of the wine or the lower-side temperature of the wine based on a result of the comparison, and the temperature adjustment system is configured to circulate the circulation liquid while the temperature of the circulation liquid is adjusted by the temperature adjuster based on the instruction to the temperature adjuster.

5. The temperature adjustment system according to claim 1, wherein the circulation pipe of each of the first temperature adjustment device and the second temperature adjustment device is comprised of a metal.

6. The temperature adjustment system according to claim 5, wherein the metal is copper.

7. The temperature adjustment system according to claim 5, wherein the metal is stainless steel.

8. A temperature adjustment system for wine stored in a concrete wine tank, the temperature adjustment system comprising:

a first temperature adjustment device; and a second temperature adjustment device, wherein each of the first temperature adjustment device and the second temperature adjustment device includes:

a circulation pipe including an inlet port configured to be on a surface of the concrete wine tank, an outlet port configured to be on the surface of the concrete wine tank, and a main pipe portion configured to be embedded in a wall of the concrete wine tank;

underground water inside the circulation pipe;

an extraction pump configured to pump up the underground water, the extraction pump including a feeding pipe portion which is coupled to the inlet port of the circulation pipe; and a discharge pipe portion coupled to the outlet port, wherein:

the first temperature adjustment device and the second temperature adjustment device are configured to circulate the underground water inside the main pipe portion;

the first temperature adjustment device is configured to be at a first position in a vertical direction of the concrete wine tank;

the second temperature adjustment device is configured to be at a second position in the vertical direction of the concrete wine tank;

the first temperature adjustment device and the second temperature adjustment device are configured to control an upper-side temperature of the wine in the concrete wine tank and a lower-side temperature of the wine in the concrete wine tank to be different by 1° C. to 2° C.; and the circulation pipe of the first temperature adjustment device is discontinuous from the circulation pipe of the second temperature adjustment device such that the circulation pipe of the first temperature adjustment device is always in fluid noncommunication with the circulation pipe of the second temperature adjustment device.

9. The temperature adjustment system according to claim 8, wherein the circulation pipe of each of the first temperature adjustment device and the second temperature adjustment device is comprised of a metal.

10. The temperature adjustment system according to claim 9, wherein the metal is copper.

11. The temperature adjustment system according to claim 9, wherein the metal is stainless steel.

12. A temperature adjustment system for wine stored in a concrete wine tank, the temperature adjustment system comprising:

a first temperature adjustment device; and a second temperature adjustment device, wherein each of the first temperature adjustment device and the second temperature adjustment device includes:

a circulation pipe including an inlet port configured to be on a surface of the concrete wine tank, an outlet port configured to be on the surface of the concrete wine tank, and a main pipe portion configured to be embedded in a wall of the concrete wine tank;

underground water inside the circulation pipe;

an extraction pump configured to pump up the underground water; and a temperature adjuster configured to adjust a temperature of the underground water and coupled to: (i) a feeding pipe portion of the extraction pump configured to receive the underground water; (ii) the inlet port of the circulation pipe; and (iii) the outlet port of the circulation pipe, wherein:

the first temperature adjustment device and the second temperature adjustment device are configured to circulate the underground water inside the main pipe portion while the temperature of the underground water is adjusted;

the first temperature adjustment device is configured to be at a first position in a vertical direction of the concrete wine tank;

the second temperature adjustment device is configured to be at a second position in the vertical direction of the concrete wine tank;

the first temperature adjustment device and the second temperature adjustment device are configured to control an upper-side temperature of the wine in the concrete wine tank and a lower-side temperature of the wine in the concrete wine tank to be different by 1° C. to 2° C.; and the circulation pipe of the first temperature adjustment device is discontinuous from the circulation pipe of the second temperature adjustment device such that the circulation pipe of the first temperature adjustment device is always in fluid noncommunication with the circulation pipe of the second temperature adjustment device.

13. The temperature adjustment system according to claim 12, wherein the circulation pipe of each of the first temperature adjustment device and the second temperature adjustment device is comprised of a metal.

14. The temperature adjustment system according to claim 13, wherein metal is copper.

15. The temperature adjustment system according to claim 13, wherein the metal is stainless steel.

* * * * *